US011302500B2

(12) United States Patent
Kimura et al.

(10) Patent No.: US 11,302,500 B2
(45) Date of Patent: Apr. 12, 2022

(54) CONTACT DEVICE AND ELECTROMAGNETIC RELAY

(71) Applicant: PANASONIC INTELLECTUAL PROPERTY MANAGEMENT CO., LTD., Osaka (JP)

(72) Inventors: Junya Kimura, Hokkaido (JP); Kohei Tani, Hokkaido (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 57 days.

(21) Appl. No.: 16/771,501

(22) PCT Filed: Nov. 20, 2018

(86) PCT No.: PCT/JP2018/042778
§ 371 (c)(1),
(2) Date: Jun. 10, 2020

(87) PCT Pub. No.: WO2019/116837
PCT Pub. Date: Jun. 20, 2019

(65) Prior Publication Data

US 2021/0183602 A1 Jun. 17, 2021

(30) Foreign Application Priority Data

Dec. 12, 2017 (JP) ..... JP2017-238044

(51) Int. Cl.
*H01H 50/12* (2006.01)
*H01H 50/14* (2006.01)
(Continued)

(52) U.S. Cl.
CPC ..... *H01H 50/12* (2013.01); *H01H 50/14* (2013.01); *H01H 50/443* (2013.01); *H01H 50/56* (2013.01)

(58) Field of Classification Search
CPC ..... H01H 50/12; H01H 50/14; H01H 50/443; H01H 50/56; H01H 50/62; H01H 50/646; H01H 50/54
See application file for complete search history.

(56) References Cited

U.S. PATENT DOCUMENTS

2013/0241679 A1 9/2013 Kobayashi
2014/0247099 A1 9/2014 Carrete et al.

FOREIGN PATENT DOCUMENTS

DE 1 564 756 B1 10/1970
JP 2010-108654 5/2010
(Continued)

OTHER PUBLICATIONS

Official Communication issued in International Patent Application No. PCT/JP2018/042778, dated Jan. 29, 2019, along with an English translation thereof.
(Continued)

*Primary Examiner* — Mohamad A Musleh
(74) *Attorney, Agent, or Firm* — Greenblum & Bernstein, P.L.C.

(57) ABSTRACT

A contact device of the present disclosure includes a fixed terminal, a movable member, a regulating member, and a heat transmission structure. The fixed terminal includes a fixed contact. The movable member includes a movable contact and is configured to move between a closed position where the movable contact is in contact with the fixed contact and an open position where the movable contact is apart from the fixed contact. The regulating member is configured to be in contact with the movable contact when the movable member is in the open position. The heat transmission structure is configured to transmit, to the fixed terminal, heat from the movable contact when the movable
(Continued)

member is in the open position, through a thermal path including at least the regulating member.

12 Claims, 9 Drawing Sheets

(51) Int. Cl.
*H01H 50/44* (2006.01)
*H01H 50/56* (2006.01)

(56) References Cited

FOREIGN PATENT DOCUMENTS

| | | |
|---|---|---|
| JP | 2010-108656 | 5/2010 |
| JP | 2013-196763 A | 9/2013 |
| JP | 2018-125159 | 8/2018 |
| KR | 20-0425067 Y1 | 9/2006 |

OTHER PUBLICATIONS

Extended European Search Report, dated Nov. 13, 2020 by the European Patent Office (EPO), for the corresponding European Patent Application No. 18889326.7.
Japan Office Action (including English Language Machine Translation), dated Sep. 7, 2021 by the Japan Patent Office (JPO) for Japanese Patent Application No. 2017-238044.

CONTACT DEVICE AND ELECTROMAGNETIC RELAY

CROSS-REFERENCE TO RELATED APPLICATIONS

This application is a National Stage of International Application No. PCT/JP2018/042778 filed Nov. 20, 2018, claiming priority to Japanese Patent Application No. 2017-238044 filed Dec. 12, 2017, and the contents of each noted application is hereby incorporated by reference in its entirety.

TECHNICAL FIELD

The present disclosure generally relates to contact devices and electromagnetic relays, and specifically, to a contact device and an electromagnetic relay including a fixed contact and a movable contact.

BACKGROUND ART

Patent Literature 1 describes an electromagnetic relay for opening and closing contacts by an electromagnet. The electromagnetic relay described in Patent Literature 1 is provided with the contact unit includes a fixed contact and a movable contact which is fixed to a movable spring serving as an electrically conductive flat spring. The fixed contact is connected to a fixed contact terminal and is located on an iron core side of the movable contact to face the movable contact.

The electromagnetic relay described in Patent Literature 1 has such a configuration that the fixed contact terminal has one end connected to the fixed contact and the other end exposed to an outer side of a housing, and the fixed contact terminal is in contact with outside air. Therefore, when the electromagnetic relay is used in a low-temperature environment, the fixed contact terminal in contact with the outside air rapidly cools the fixed contact, and thereby, air in the vicinity of the fixed contact forms condensation and freezes on the fixed contact, which may lead to a defect of electrical connection between the contacts.

CITATION LIST

Patent Literature

Patent Literature 1: JP 2010-108656 A

SUMMARY OF INVENTION

In view of the foregoing, it is an object of the present disclosure to provide a contact device and an electromagnetic relay configured to reduce defects of electrical connection between contacts caused by freezing.

A contact device according to one aspect of the present disclosure includes a fixed terminal, a movable member, a regulating member, and a heat transmission structure. The fixed terminal includes a fixed contact. The movable member includes a movable contact and is configured to move between a closed position where the movable contact is in contact with the fixed contact and an open position where the movable contact is apart from the fixed contact. The regulating member is configured to be in contact with the movable contact when the movable member is in the open position. The heat transmission structure is configured to transmit, to the fixed terminal, heat from the movable contact when the movable member is in the open position, through a thermal path including at least the regulating member.

An electromagnetic relay according to one aspect of the present disclosure includes the contact device and an electromagnet having a coil.

DESCRIPTION OF EMBODIMENTS

First Embodiment (1) Schema

A schema of a contact device A1 and an electromagnetic relay 100 according to the present embodiment will be described below by referring to FIGS. 1 and 2.

The electromagnetic relay 100 according to the present embodiment is, for example, a device for switching a supply state of direct-current power from a battery of a vehicle to a load (e.g., a lamp or a motor). In the electromagnetic relay 100 according to the present embodiment, the contact device A1 is inserted into a supply path of the direct-current power from a power supply such as the battery to the load, and the supply state of the direct-current power from the power supply to the load is switchable by opening and closing the contact device A1.

Figure 1:
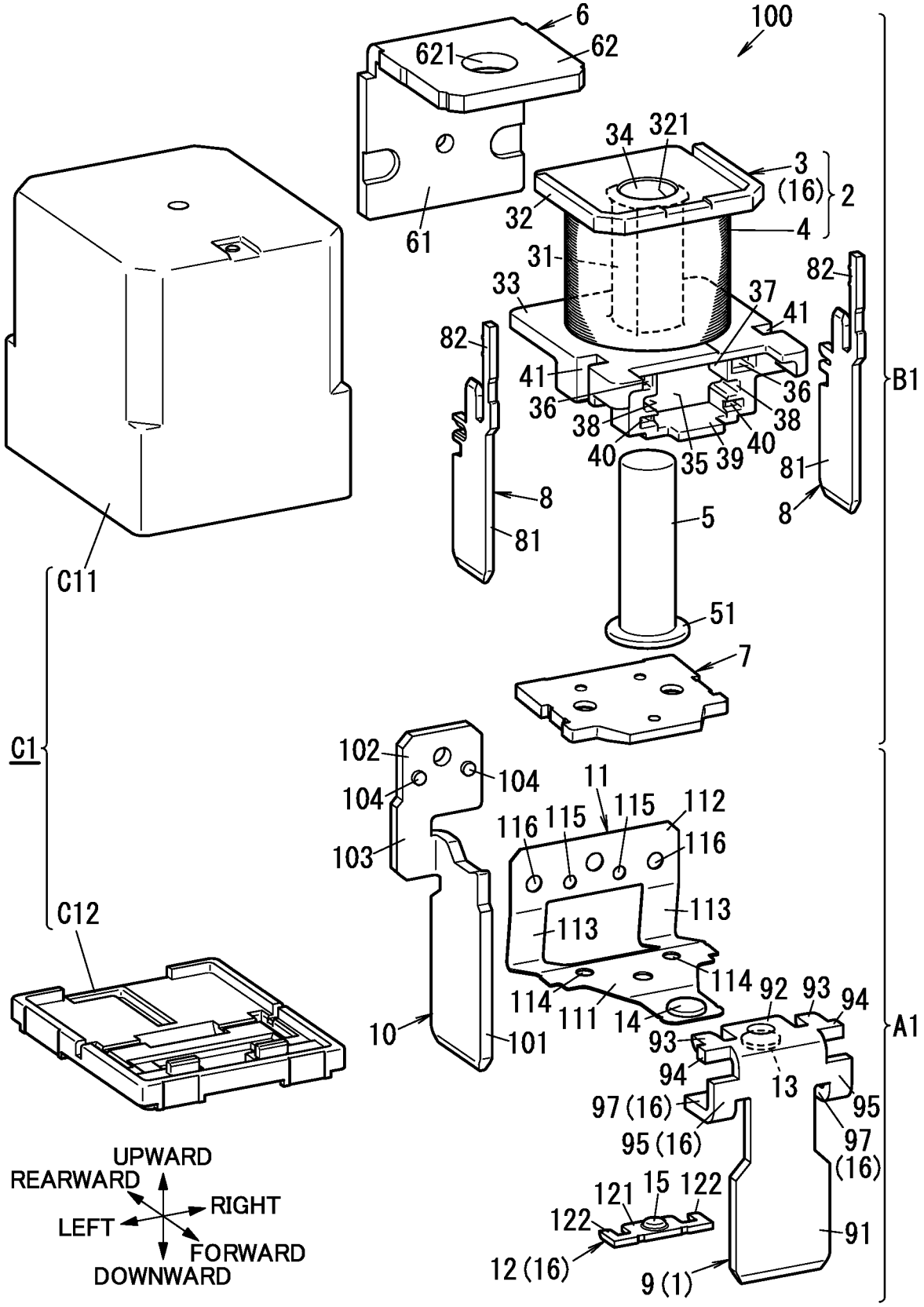
FIG. 1 is an exploded perspective view illustrating an electromagnetic relay according to a first embodiment.
Figure 2:
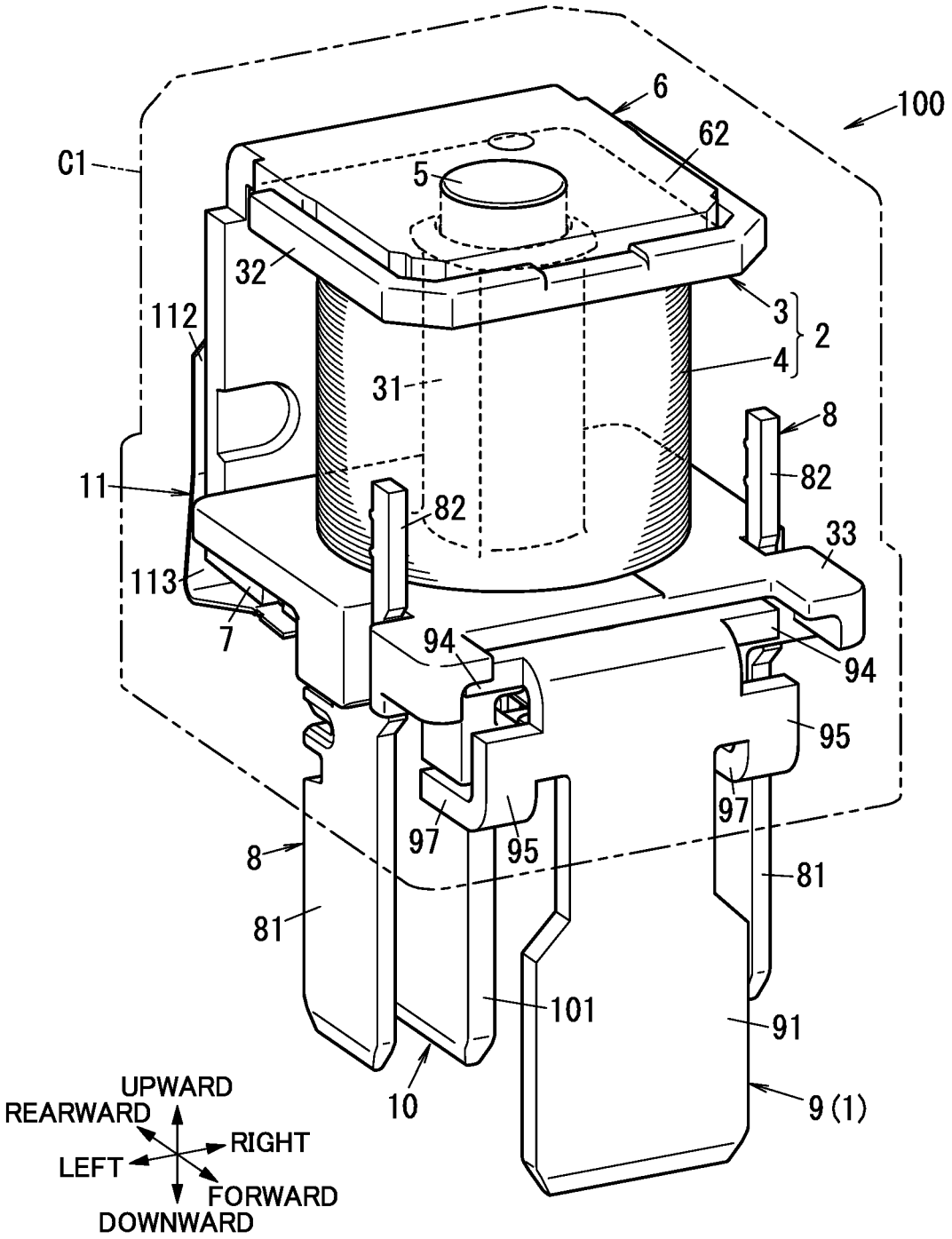
FIG. 2 is an external view illustrating the electromagnetic relay.

As illustrated in FIGS. 1 and 2, the contact device A1 according to the present embodiment includes a fixed terminal 1, a movable member 11, a regulating member 12, and a heat transmission structure 16. The fixed terminal 1 includes a fixed contact 13. The movable member 11 includes a movable contact 14 and is configured to move between a closed position where the movable contact 14 is in contact with the fixed contact 13 and an open position where the movable contact 14 is apart from the fixed contact 13. The regulating member 12 is configured to be in contact with the movable contact 14 when the movable member 11 is in the open position. The heat transmission structure 16 is configured to transmit, to the fixed terminal 1, heat from the movable contact 14 when the movable member 11 is in the open position, through a thermal path R1 (see FIG. 4) including at least the regulating member 12.

As illustrated in FIG. 1, the electromagnetic relay 100 according to the present embodiment includes the contact device A1 and an electromagnet 2 having a coil 4.

The contact device A1 and the electromagnetic relay 100 according to the present embodiment enable the heat from the movable contact 14 to be transmitted to the fixed terminal 1 via the heat transmission structure 16. Thus, the temperature of the fixed terminal 1 does not decrease much even when the contact device A1 and the electromagnetic relay 100 are used under a low-temperature environment where an ambient temperature is low (lower than or equal to 0° C.) such as in a winter season or in a cold district. Therefore, the temperature of the fixed contact 13 does not deceases much, moisture in air in the vicinity of the fixed contact 13 hardly forms condensation and freezes on the fixed contact 13, and it is therefore possible to reduce defects of electrical connection between the contacts caused by freezing.

(2) Configuration

Configuration of a contact device A1 and an electromagnetic relay 100 according to the present embodiment will be described below by referring to FIG. 1 and FIG. 2.

In the following description, a direction in which the fixed contact 13 and the movable contact 14 are arranged with each other is referred to as an upward and downward direction, a side on which the fixed contact 13 is provided as viewed from the movable contact 14 is referred to as an upside, and an opposite side to the upside is referred to as a downside. Further, in the following description, a direction in which a first terminal plate 9 and a second terminal plate 10 are aligned with each other is referred to as a forward and rearward direction, a side on which the first terminal plate 9 is provided when viewed from the second terminal plate 10 is referred to as a front side, and an opposite side to the front side is referred to as a back side. Furthermore, in the following description, a direction in which a pair of coil terminal plates 8 are aligned with each other is referred to as a right and left direction.

These directions are, however, not intended to define the use direction of the contact device A1 and the electromagnetic relay 100. Moreover, arrows indicating "forward, "rearward", "right", "left", "upward", and "downward" in the figures are shown for the sake of explanation and are not accompanied with entity.

The electromagnetic relay 100 according to the present embodiment is a so-called hinge type relay. As illustrated in FIG. 1, the electromagnetic relay 100 according to the present embodiment includes the contact device A1, an electromagnet device B1, and a case C1.

(2.1) Contact Device

As illustrated in FIGS. 1 and 2, the contact device A1 includes the first terminal plate 9 as the fixed terminal 1, the second terminal plate 10, the movable member 11, and the contact plate 12.

The first terminal plate 9 (the fixed terminal 1) is made of a conductive material (e.g., copper or a copper alloy) and is L-shaped when viewed in the right and left direction. The first terminal plate 9 has a terminal part 91, a contact part 92, a pair of lugs 93, a pair of first projections 94, a pair of second projections 95, and a pair of extended parts 97. The terminal part 91 has a rectangular shape elongated in the upward and downward direction when viewed in the forward and rearward direction. The contact part 92 has a rectangular shape elongated in the right and left direction when viewed in the upward and downward direction. The contact part protrudes rearward from an upper end edge of the terminal part 91. The contact part 92 has a lower surface to which the fixed contact 13 is attached by an appropriate attachment method (e.g., fixation by swaging). In other words, the fixed terminal 1 has the fixed contact 13. The fixed contact 13 is made of, for example, a silver alloy. The fixed contact 13 may be integrated with or separate from the first terminal plate 9 (the fixed terminal 1).

At the upper end edge of the terminal part 91, each of the pair of lugs 93 protrudes rearward from a corresponding one of both right and left sides of the contact part 92. That is, each respective lug 93 protrudes in the same orientation (rearward) as the contact part 92 and is provided at a location away from the contact part 92. Each lug 93 has a rectangular shape when viewed in the upward and downward direction. Each lug 93 has a tip end (a rear end) sloped such that the thickness (dimension in the upward and downward direction) and the width (dimension in the right and left direction) decrease toward a tip of the tip end.

One of the pair of projections 94 protrudes leftward from a left end of a left lug 93 of the pair of lugs 93, and the other of the pair of projections 94 protrudes rightward from a right end of a right lug 93 of the pair of lugs 93. One of the pair of second projections 95 protrudes leftward from a left end of an upper end of the terminal part 91, and the other of the pair of second projections 95 protrudes rightward from a right end of the upper end of the terminal part 91. The pair of first projections 94 are provided to be apart from the pair of second projections 95 in a longitudinal direction of the terminal part 91. Thus, it is possible to easily bend the first terminal plate 9 between the pair of first projections 94 and the pair of second projections 95.

Each of the pair of extended parts 97 protrudes rearward from a lower end of each of the pair of second projections 95. In other words, the extended parts 97 are integrated with the fixed terminal 1. Moreover, the extended parts 97 are provided on both sides of the fixed terminal 1 in the right and left direction (a direction transverse to the direction in which the fixed contact 13 and the movable contact 14 are aligned with each other). Each extended part 97 has a rectangular shape elongated in the forward and rearward direction when viewed in the upward and downward direction. The extended parts 97 are preferably integrated with the fixed terminal 1 (the first terminal plate 9) but may be separate from the fixed terminal 1.

The second terminal plate 10 is made of a conductive material (e.g., copper or a copper alloy) in a similar manner to the first terminal plate 9. As illustrated in FIG. 1, the second terminal plate 10 has a terminal part 101, a fixing part 102, and a coupler 103. The terminal part 101 has a rectangular shape elongated in the upward and downward direction when viewed in the right and left direction. The fixing part 102 has a rectangular shape when viewed in the forward and rearward direction. The fixing part 102 has a front surface provided with a pair of rising parts 104 protruding forward. The pair of rising parts 104 are aligned with each other in the right and left direction. Each of the pair of rising parts 104 has a round shape when viewed from the front. The pair of rising parts 104 are used to attach the second terminal plate 10 to the movable member 11. The terminal part 101 and the fixing part 102 are integrally formed by the coupler 103 having a rectangular shape elongated in the upward and downward direction.

The movable member 11 is a flat spring formed of a conductive thin plate (e.g., a copper plate) and is L-shaped when viewed in the right and left direction. As illustrated in FIG. 1, the movable member 11 has an operation piece 111, a fixed piece 112, and a pair of spring pieces 113. The operation piece 111 has a triangular shape when viewed in the upward and downward direction. The operation piece 111 has a rear end having a pair of fixing holes 114 penetrating the operation piece 111 in its thickness direction (the upward and downward direction). The pair of fixing holes 114 are aligned with each other in the right and left direction. Each of the pair of fixing holes 114 has a round shape. The pair of fixing holes 114 are used to attach an armature 7 (which will be described later) to the movable member 11. Moreover, the operation piece 111 has a front end to which the movable contact 14 is attached by an appropriate attachment method (e.g., fixation by swaging). In the present embodiment, the movable contact 14 protrudes upward and downward respectively from an upper surface and a lower surface of the operation piece 111 such that the movable contact 14 is accessible to the fixed contact 13 of the first terminal plate 9 and a second fixed contact 15 (which will be described later) of the contact plate 12. The movable contact 14 may be integrated with or separate from the movable member 11.

The fixed piece 112 has a rectangular shape elongated in the right and left direction when viewed in the forward and rearward direction. The fixed piece 112 has a lower end having a pair of fixing holes 115 and a pair of fixing holes 116 penetrating the fixed piece 112 in its thickness direction (the forward and rearward direction). The pair of fixing holes 115 are aligned with each other in the right and left direction. Moreover, the pair of fixing holes 116 are aligned with each other in the right and left direction. Each of the fixing holes 115 and 116 has a round shape. The pair of fixing holes 115 are provided between the pair of fixing holes 116 in the right and left direction. That is, the distance between the pair of fixing holes 115 is shorter than the space between the pair of fixing holes 116. The pair of fixing holes 115 are used to attach the second terminal plate 10 to the movable member 11. Specifically, the pair of rising parts 104 inserted in the pair of fixing holes 115 are fixed to the movable member 11 by swaging, thereby attaching the second terminal plate 10 to the movable member 11. Moreover, the pair of fixing holes 116 are used to attach a yoke 6 (which will be described later) to the movable member 11. Specifically, after a pair of rising parts provided on a rear surface of a first plate 61 (which will be described later) of the yoke 6 are inserted in the pair of fixing holes 116, the pair of rising parts are fixed to the movable member 11 by swaging, thereby attaching the yoke 6 to the movable member 11.

The pair of spring pieces 113 are bent at an intermediate portion in a longitudinal direction of the pair of spring pieces 113 and connect the operation piece 111 to the fixed piece 112 at both ends of the operation piece 111 and the fixed piece 112 in the right and left direction.

The movable member 11 is configured to warp when the armature 7 is in a first location (location where the armature 7 is in contact with an attraction section 51 (which will be described later)). Then, the movable member 11 attempts to return to an initial state, thereby applying, to the armature 7, force oriented to move the armature 7 from the first location to a second location (location where the armature 7 is apart from the attraction section 51). That is, the movable member 11 is configured to apply, to the armature 7, force which is generated by resilience and which is oriented to move the armature 7 from the first location to the second location.

Here, in the present embodiment, the movable contact 14 of the movable member 11 is in contact with the fixed contact 13 when the armature 7 is in the first location, and the movable contact 14 of the movable member 11 is apart from the fixed contact 13 when the armature 7 is in the second location. That is, the position of the movable member 11 when the armature 7 is in the first location is the closed position, and the position of the movable member 11 when the armature 7 is in the second location is the open position. In other words, the movable member 11 has the movable contact 14 and is configured to move between the closed position where the movable contact 14 is in contact with the fixed contact 13 and the open position where the movable contact 14 is apart from the fixed contact 13.

The contact plate 12 is made of a conductive material (e.g., copper or a copper alloy) and has a rectangular shape elongated in the right and left direction when viewed in the upward and downward direction. As illustrated in FIG. 1, the contact plate 12 has a second contact part 121 and a pair of second lugs 122. The second contact part 121 has a rectangular shape elongated in the right and left direction when viewed in the upward and downward direction. The second contact part 121 has an upper surface to which the second fixed contact 15 is attached by an appropriate attachment method (e.g., fixation by swaging). The pair of second lugs 122 protrude rearward at locations away from the second contact part 121 on both right and left sides of the second contact part 121. The contact plate 12 is configured such that the movable contact 14 of the movable member 11 is in contact with the second fixed contact 15 in state where the armature 7 is in the second location. The second fixed contact 15 is a dummy contact that regulates movement of the movable member 11. That is, the contact plate 12 is a regulating member (hereinafter also referred to as a "regulating member 12") that regulates the movement of the movable member 11, and the contact plate 12 is in contact with the movable contact 14 when the movable member 11 is in the open position.

(2.2) Electromagnet Device

As illustrated in FIGS. 1 and 2, the electromagnet device B1 includes the electromagnet 2, a stator 5, the yoke 6, the armature 7, and the pair of coil terminal plates 8. Each of the stator 5, the yoke 6, and the armature 7 is made of a magnetic material.

As illustrated in FIGS. 1 and 2, the electromagnet 2 has a coil bobbin 3 and the coil 4.

The coil bobbin 3 is made of, for example, an electrically insulating material such as a synthetic resin and is arranged such that an axial direction of the coil bobbin 3 coincides with the upward and downward direction. The coil bobbin 3 includes a winding body section 31, an upper flange 32, and a lower flange 33. The winding body section 31 has a cylindrical shape elongated in the upward and downward direction and has a hollow 34 through which the stator 5 is inserted. The upper flange 32 has a rectangular shape when viewed in the upward and downward direction and is integrally formed with one end (upper end) of the winding body section 31. The upper flange 32 has a central part having a through hole 321 being round and penetrating the upper flange 32 in its thickness direction (the upward and downward direction). The through hole 321 is communicated with the hollow 34 in the body section 31 in the upward and downward direction.

The lower flange 33 has a rectangular shape when viewed in the upward and downward direction and is integrally formed with the other end (lower end) of the winding body section 31. The lower flange 33 has a central part having a through hole penetrating the lower flange 33 in its thickness direction (the upward and downward direction). The through hole in the lower flange 33 is communicated with the hollow 34 in the body section 31 in the upward and downward direction. In other words, the hollow 34 in the body section 31, the through hole 321 in the upper flange 32, and the through hole in the lower flange 33 constitute a through hole penetrating the coil bobbin 3 in the upward and downward direction.

The lower flange 33 includes an accommodation section (first accommodation section) 35, a pair of holders (first holders) 36, and a pair of separators 37. The lower flange 33 further includes a pair of grooves 38, a second accommodation section 39, and a pair of second holders 40. Note that in a structure in which the coil bobbin 3 does not hold the contact plate (the regulating member) 12, the second accommodation section 39 and the pair of second holders 40 may be omitted.

The accommodation section 35 has a shape of a box whose front surface and lower surface are open. The dimension of the accommodation section 35 in the forward and rearward direction is larger than the dimension of the contact part 92 of the first terminal plate 9 in the forward and rearward direction. The dimension of the accommodation section 35 in the right and left direction is larger than the dimension (width dimension) of the contact part 92 in the right and left direction. Moreover, the dimension of the accommodation section 35 in the upward and downward direction is larger than the dimension (thickness dimension) of the contact part 92 in the upward and downward direction. That is, in state where the contact part 92 is accommodated in the accommodation section 35, the contact part 92 and the accommodation section 35 are not in contact with each other.

Each of the pair of holders 36 is provided on a corresponding one of both right and left sides of the accommodation section 35. Each of the pair of holders 36 has a shape of a box whose front surface is open. The pair of holders 36 and the pair of lugs 93 correspond to each other on a one-to-one basis. Each of the pair of lugs 93 is inserted into a corresponding holder 36 of the pair of holders 36 and is held by the corresponding holder 36, and thereby, the first terminal plate 9 is attached to the coil bobbin 3.

Each of the pair of separators 37 is provided between the accommodation section 35 and a corresponding one of the holders 36 in the right and left direction. In the present embodiment, each of the pair of separators 37 is a longitudinal wall formed between the accommodation section 35 and the corresponding one of the holders 36 in the right and left direction.

Each of the pair of grooves 38 has a U-shape when viewed in the forward and rearward direction and is formed such that an open side of the U-shape is on an inner side in the right and left direction. The operation piece 111 of the movable member 11 is disposed in a space formed by the pair of grooves 38. Thus, the dimension of each groove 38 in the upward and downward direction is a dimension which allows the operation piece 111 to be moved between the closed position and the open position.

The second accommodation section 39 has a shape of a box whose front surface, rear surface, and upper surface are open. Each of the pair of second holders 40 is provided on a corresponding one of both right and left side of the second accommodation section 39. The second accommodation section 39 and the pair of second holders 40 are used to attach the contact plate 12, to which the second fixed contact 15 has been attached, to the coil bobbin 3. That is, each of the second lugs 122 is held by a corresponding second holder 40 of the pair of second holders 40, and thereby, the contact plate 12 is attached to the coil bobbin 3. At this time, the second contact part 121 including the second fixed contact 15 is accommodated in the second accommodation section 39. That is, in the present embodiment, the fixed terminal 1 (the first terminal plate 9) and the regulating member (contact plate) 12 are held by the coil bobbin 3.

Moreover, the lower flange 33 has both right and left sides having grooves 41 in which winding wire sections 82 (which will be described later) of the pair of coil terminal plates 8 are to be inserted.

The coil 4 is formed by winding an electric wire (e.g., copper wire) around the body section 31 of the coil bobbin 3. The coil 4 is electrically connected to the pair of coil terminal plates 8 by winding a first end of the electric wire around the winding wire sections 82 of one of the pair of coil terminal plates 8 and a second end of the electric wire around the winding wire section 82 of the other of the pair of coil terminal plates 8. The coil 4 generates a magnetic flux when supplied with a current via the pair of coil terminal plates 8.

The stator 5 is a columnar iron core elongated in the upward and downward direction. The stator 5 is inserted in the hollow 34 formed in the coil bobbin 3 in a state where both ends of the stator 5 in its longitudinal direction (the upward and downward direction) are exposed from the coil bobbin 3. The stator 5 has a first end (lower end) in a longitudinal direction of the stator 5, and the first end has a larger diameter than an intermediate portion of the stator 5 and faces the armature 7. In the following description, the first end of the stator 5 is referred to as the "attraction section 51". Moreover, the stator 5 has a second end (upper end) in the longitudinal direction of the stator 5, and the second end is inserted into an insertion hole 621 (which will be described later) in a second plate 62 (which will be described later) of the yoke 6, and the stator 5 is fixed to the yoke 6.

The Yoke 6, together with the stator 5 and the armature 7, forms a flux path through which a magnetic flux generated when the electromagnet 2 is energized passes. The yoke 6 is formed by bending an intermediate portion of a plate having a rectangular shape elongated in the upward and downward direction into an L-shape when viewed in the right and left direction. As illustrated in FIG. 1, the yoke 6 has the first plate 61 and the second plate 62. Both the first plate 61 and the second plate 62 are rectangular. The second plate 62 is located on one end side (an upper side) in an axial direction (the upward and downward direction) of the coil 4. The second plate 62 has the insertion hole 621 being round and penetrating the second plate 62 in its thickness direction (the upward and downward direction). The second end of the stator 5 is inserted into the insertion hole 621. The first plate 61 is located behind the coil 4. Note that the rear surface of the first plate 61 has a pair of rising parts protruding rearward and integrated with the rear surface. After inserting the pair of rising parts into the pair of fixing holes 116 formed in the fixed piece 112 of the movable member 11 on a one-to-one basis, the pair of rising parts are fixed to the fixed piece 112 by swaging, and thereby, the movable member 11 is attached to the yoke 6.

The armature 7 has a rectangular shape when viewed in the upward and downward direction. The armature 7 has a lower surface integrally provided with a pair of rising parts protruding downward. After inserting the pair of rising parts into the pair of fixing holes 114 formed in the operation piece 111 of the movable member 11 on a one-to-one basis, the pair of rising parts are fixed to the operation piece 111 by swaging, and thereby, the armature 7 is attached to the movable member 11.

Each of the pair of coil terminal plates 8 is made of a conductive material (e.g., copper or a copper alloy) in a similar manner to the first terminal plate 9 and the second terminal plate 10. As illustrated in FIGS. 1 and 2, each of the pair of coil terminal plates 8 has a coil terminal part 81 and the winding wire section 82. The coil terminal part 81 has a rectangular shape elongated in the upward and downward direction when viewed in the right and left direction. The winding wire section 82 has a bar shape elongated in the upward and downward direction and is integrally formed on an upper end edge of the coil terminal part 81. The first end or the second end of the electric wire forming the coil 4 is wound around the winding wire section 82.

(2.3) Case

The case C1 has a box shape and is made of an electrically insulating material such as a synthetic resin. As illustrated in FIG. 1, the case C1 has a cover C11 and a base C12 having a plate shape. The cover C11 has a shape of a box whose lower surface is open. The base C12 is to be attached to the cover C11 to close the opening at the lower surface of the cover C11. The case C1 is formed by connecting the cover C11 and the base C12 to each other by, for example, bonding using an adhesive of a thermosetting resin or the like. The case C1 accommodates the contact device A1 and the electromagnet device B1. In a state where the contact device A1 and the electromagnet device B1 are accommodated in the case C1, one end (lower end) of the terminal part 91 of the first terminal plate 9, a lower end of the terminal part 101 of the second terminal plate 10, and a lower end of the coil terminal part 81 of each of the pair of coil terminal plates 8 are exposed from the case C1 (see FIG. 2).

(3) Operation

Operation of the electromagnetic relay 100 according to the present embodiment will be described below.

First of all, closing operation of the contact device A1 will be described. In an OFF state of the contact device A1, the movable member 11 is located at the open position due to resilient force of the pair of spring pieces 113. At this time, the movable contact 14 is in contact with the second fixed contact 15 of the second contact part 121 of the contact plate 12. Moreover, the armature 7 is attached to the operation piece 111 of the movable member 11 and is thus located at a location (second location) apart from the attraction section 51 of the stator 5.

In the OFF state of the contact device A1, energizing the coil 4 of the electromagnet 2 causes the coil 4 to generate a magnetic flux. This generates magnetic attractive force between the armature 7 and the attraction section 51 of the stator 5 to attract the armature 7 to the attraction section 51 against the resilient force of the movable member 11. Thus, the armature 7 rotates about a fulcrum which is a part of the armature 7 and which is in contact with the yoke 6, and the armature 7 moves from the second location to the first location.

As the armature 7 moves to the first location, the operation piece 111 of the movable member 11 to which the armature 7 is attached also rotates against the resilient force of the pair of spring pieces 113. As a result, the movable contact 14 moves away from the second fixed contact 15 and comes into contact with the fixed contact 13 of the contact part 92 of the first terminal plate 9. Thus, the contact device A1 transitions to an ON state, and the first terminal plate 9 and the second terminal plate 10 are electrically connected to each other via the fixed contact 13 and the movable contact 14.

Next, open operation of the contact device A1 will be described. In the ON state of the contact device A1, de-energizing the coil 4 of the electromagnet 2 causes the coil 4 to no longer generate the magnetic flux. Thus, the magnetic attractive force between the armature 7 and the attraction section 51 of the stator 5 is also lost. Then, the armature 7 rotates in a direction opposite to the direction in the close operation by the resilient force of the pair of spring pieces 113 of the movable member 11 and moves from the first location to the second location.

As the armature 7 moves to the second location, the operation piece 111 of the movable member 11 to which the armature 7 is attached is also rotated by the resilient force of the pair of spring pieces 113 in a direction opposite to the direction in the close operation. As a result, the movable contact 14 moves away from the fixed contact 13 and comes into contact with the second fixed contact 15. Thus, the contact device A1 transitions to the OFF state.

(4) Heat Transmission Structure

The heat transmission 16 according to the present embodiment will be described below with reference to FIGS. 3 and 4.

(4.1) Configuration

Figure 3:
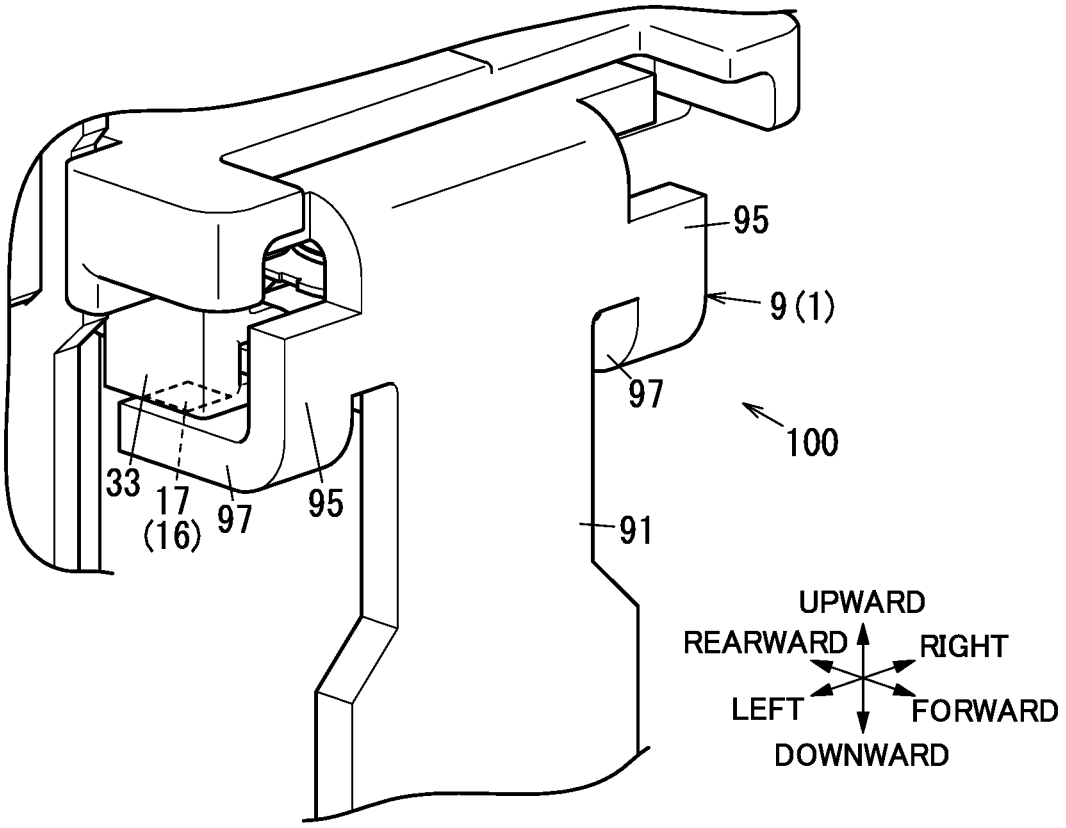
FIG. 3 is an enlarged view illustrating a main part of the electromagnetic relay.
Figure 4:
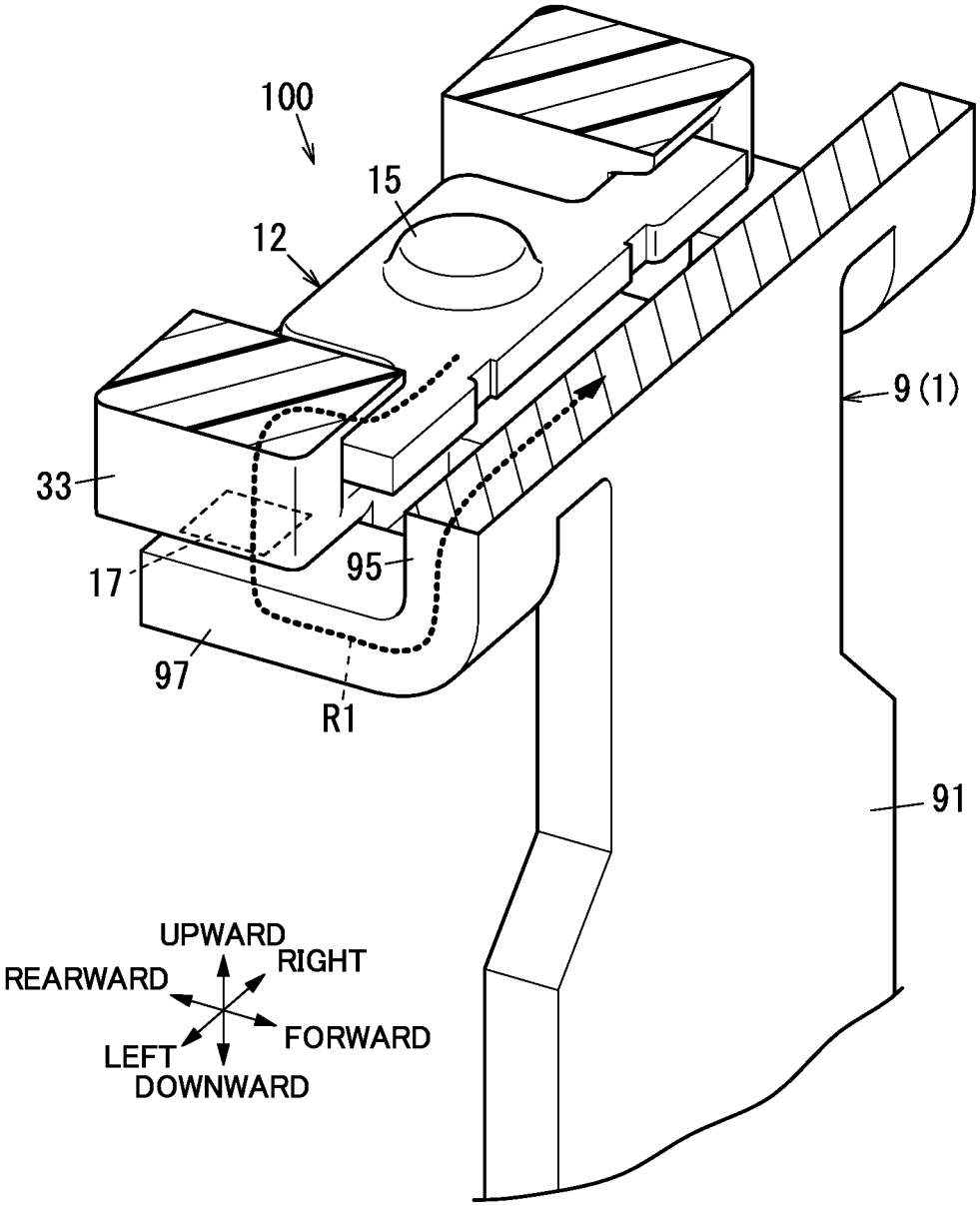
FIG. 4 is a view illustrating a thermal path in the electromagnetic relay.

FIG. 3 is an enlarged view illustrating a main part of the electromagnetic relay 100 according to the present embodiment. In a state where the coil bobbin 3 holds the fixed terminal 1, an upper surface of the extended part 97 and a lower surface of the lower flange 33 of the coil bobbin 3 face each other in the upward and downward direction. In other words, a tip end of the extended part 97 faces a holding structure (the coil bobbin 3) that holds the regulating member 12. The present embodiment includes a seal member 17 provided in a gap between the upper surface of the extended part 97 and the lower surface of the lower flange 33. In other words, the seal member 17 is provided in a gap between the tip end of the extended part 97 and a counter portion facing the tip end of the extended part 97 in the holding structure that holds the regulating member 12. That is, in the present embodiment, the upper surface of the extended part 97 and the lower surface of the lower flange 33 are not in direct contact with each other but are in contact with each other with the seal member 17 provided therebetween. The seal member 17 is, for example, an adhesive made of an epoxy resin.

Thus, in the electromagnetic relay 100 according to the present embodiment, the coil bobbin 3 (strictly speaking, the lower flange 33) which is the holding structure that holds the regulating member 12 and the extended part 97 are in contact with each other with the seal member 17 provided therebetween. This allows heat transmitted from the movable contact 14 to the second fixed contact 15 upon completion of transition of the contact device A1 from the ON state to the OFF state to be transmitted to the fixed terminal 1 via the regulating member (contact plate) 12, the coil bobbin 3, the seal member 17, the extended part 97, and the second projection 95. Therefore, even in the case of use in a low-temperature environment, the temperature of the fixed terminal 1 does not decrease much, and the temperature of the fixed contact 13 attached to the fixed terminal 1 also does not decrease much. Therefore, it is possible to reduce a temperature difference between the temperature of the fixed contact 13 and the temperature of the vicinity of the fixed contact 13. Thus, moisture in air around the fixed contact 13 hardly forms condensation and freezes on the fixed contact 13, and it is thus possible to reduce defects of electrical connection between the contacts (defects of electrical connection between the fixed contact 13 and the movable contact 14) due to freezing.

In the present embodiment, the heat transmission 16 includes the regulating member (contact plate) 12, the coil bobbin 3, the seal member 17, the extended part 97, and the second projection 95. In other words, the heat transmission structure 16 includes the extended part 97 extending from the fixed terminal 1 toward the regulating member 12. Moreover, the heat transmission structure 16 is configured to transmit, to the fixed terminal 1, heat from the movable contact 14 when the movable member 11 is in the open position, through a thermal path R1 (see FIG. 4) including at least the regulating member 12.

(4.2) Operation

Next, operation of transmitting heat from the movable contact 14 to the fixed terminal 1 will be described with reference to FIG. 4. In FIG. 4, "R1" indicates a thermal path of heat transmitted from the movable contact 14 to the second fixed contact 15. As illustrated in FIGS. 1 and 4, the thermal path R1 is connected between the fixed contact 13 and the terminal part 91 of the first terminal plate 9 (fixed terminal 1).

When the contact device A1 is in the ON state, the movable contact 14 is in contact with the fixed contact 13 and a current flows between the two contacts, and therefore, the temperature of the movable contact 14 is increasing. The temperature of the coil 4 is also increasing. When the contact device A1 transitions from the ON state to the OFF state, the movable contact 14 moves away from the fixed contact 13 and comes into contact with the second fixed contact 15. Of heat generated at the movable contact 14 and heat generated at the coil 4, heat transmitted to the movable contact 14 via the spring pieces 113 of the movable member 11 is transmitted from the movable contact 14 to the second fixed contact 15. The heat transmitted to the second fixed contact 15 is transmitted to the regulating member (contact plate) 12 and is then transmitted from the regulating member (contact plate) 12 to the lower flange 33 of the coil bobbin 3. Then, the heat transmitted to the lower flange 33 is transmitted to the terminal part 91 via the seal member 17, the extended part 97, and the second projection 95 (see the thermal path R1 in FIG. 4).

Here, in a state where the electromagnetic relay 100 is assembled, as shown in FIG. 2, the terminal part 91 of the first terminal plate 9 (fixed terminal 1) protrudes out of the case C1. In other words, the fixed terminal 1 (the first terminal plate 9) has the terminal part 91 protruding out of the case C1 which accommodates at least part of the fixed terminal 1. Therefore, when the electromagnetic relay 100 is used at low-temperature environment, the temperature of the one end (lower end) of the terminal part 91 decreases. However, when the heat from the movable contact 14 is transmitted to the terminal part 91 as in the case of the electromagnetic relay 100 of the present embodiment, the temperature of the terminal part 91 in the vicinity of the heat transmission structure 16 does not decrease much. Since the fixed contact 13 is disposed at a location closer to the heat transmission structure 16 than to the one end of the terminal part 91, the temperature of the fixed contact 13 attached to the other end of the terminal part 91 also does not decrease much. Therefore, it is possible to reduce the temperature difference between the temperature of the fixed contact 13 and the temperature of the vicinity of the fixed contact 13. Thus, according to the electromagnetic relay 100 of the present embodiment, moisture in air around the fixed contact 13 hardly forms condensation and freezes on the fixed contact 13, and it is therefore possible to reduce defects of electrical connection between the contacts due to freezing.

(5) Variation

The first embodiment is only one of various embodiments of the present disclosure. Various modifications may be made to the first embodiment depending on design and the like as long as the object of the present disclosure is achieved. Variations of the first embodiment will be described below. Note that any of the variations to be described below may be combined as appropriate.

(5.1) First Variation

Figure 5:
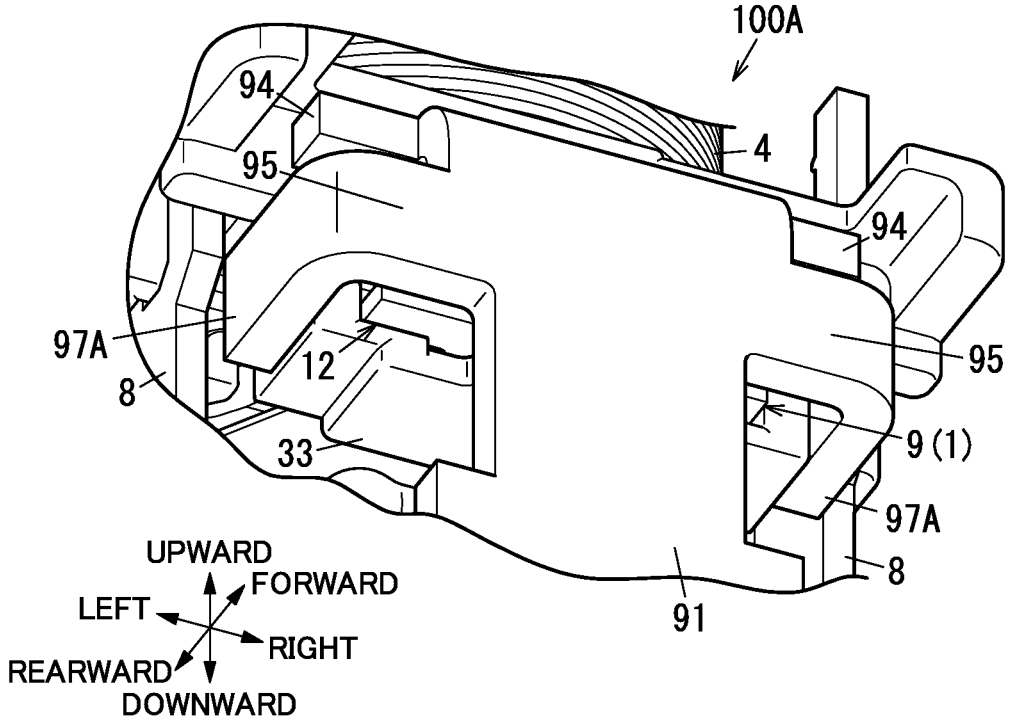
FIG. 5 is an enlarged view illustrating a main part of an electromagnetic relay of a variation of the first embodiment.

In the first embodiment, each extended part 97 protrudes rearward from the lower end of a corresponding one of the second projections 95. However, as illustrated in FIG. 5, each extended part 97 may protrude rearward from a left end or a right end of the second projections 95. An electromagnetic relay 100A according to a first variation of the first embodiment will be described below by referring to FIGS. 5 and 6. Note that components other than the fixed terminal 1 (first terminal plate 9) are the same as those of the first embodiment, and therefore, the same components are denoted by the same reference signs as those in the first embodiment, and the detailed description thereof is omitted.

(5.1.1) Configuration

As illustrated in FIG. 5, the first terminal plate 9 (the fixed terminal 1) according to the first variation includes a terminal part 91, a contact part 92 (see FIG. 1), a pair of lugs 93 (see FIG. 1), a pair of first projections 94, a pair of second projections 95, and a pair of extended parts 97A. One of the pair of extended parts 97A protrudes rearward from a left end of a left second projection 95 of the pair of second projections 95, and the other of the pair of extended parts 97A protrudes rearward from a right end of a right second projection 95 of the pair of second projections 95.

In a state where the electromagnetic relay 100A is assembled, each extended part 97A is in contact with a left side surface or a right side surface of a lower flange 33 of a coil bobbin 3 serving as a holding structure that holds a regulating member (contact plate) 12. Note that the lower flange 33 and each of the extended parts 97A may be in direct contact with each other or may be in contact with each other with a seal member provided therebetween.

(5.1.2) Operation

Figure 6:
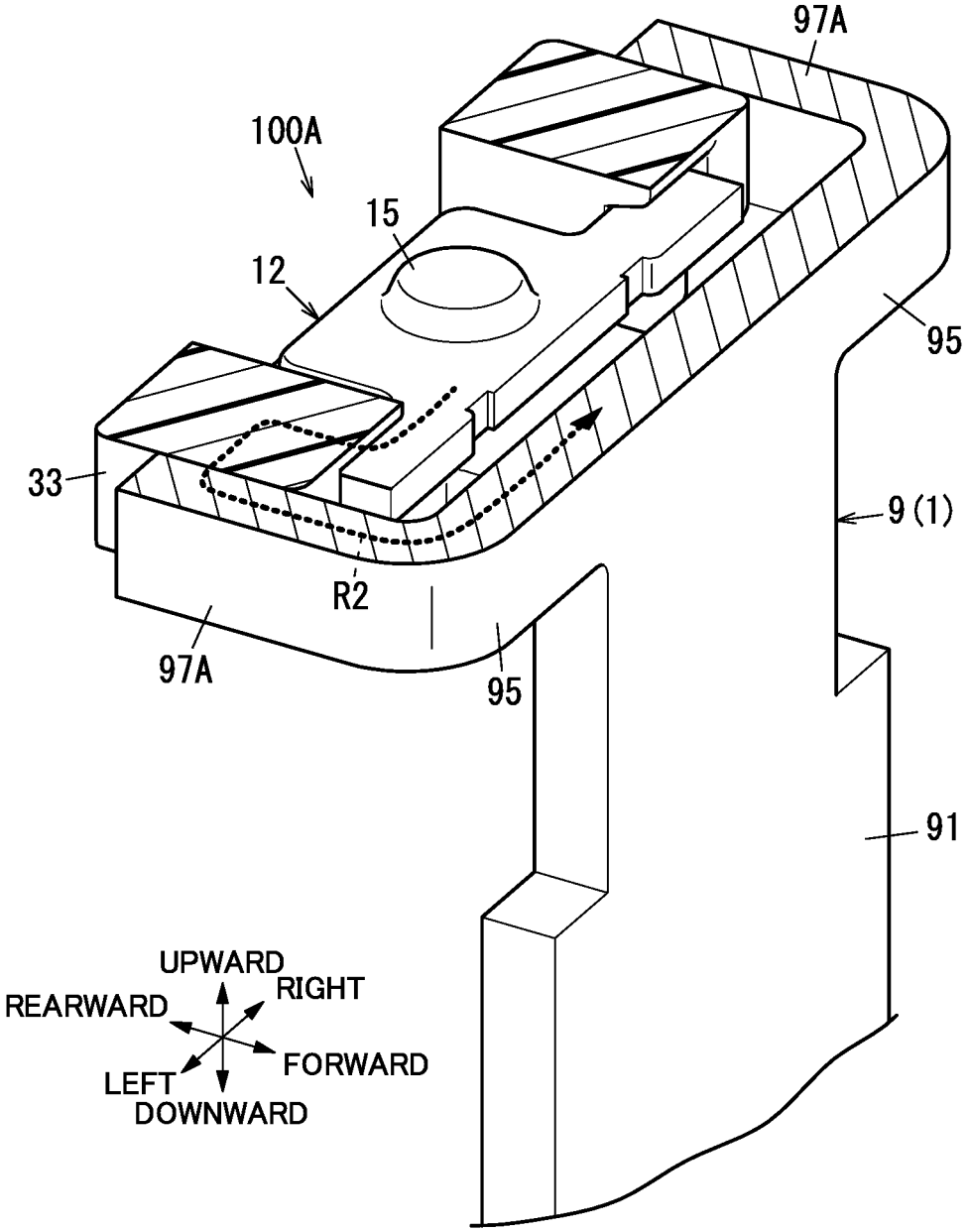
FIG. 6 is a view illustrating a thermal path in the electromagnetic relay of the variation.

Next, operation of transmitting heat from a movable contact 14 to the fixed terminal 1 will be described with reference to FIG. 6. In FIG. 6, "R2" indicates a thermal path of heat transmitted from the movable contact 14 to a second fixed contact 15.

When the contact device A1 is in the ON state, the movable contact 14 is in contact with a fixed contact 13, and a current flows between the two contacts, and therefore, the temperature of the movable contact 14 is increasing. The temperature of a coil 4 is also increasing. When a contact device A1 transitions from the ON state to the OFF state, the movable contact 14 moves away from the fixed contact 13 and comes into contact with the second fixed contact 15. Of heat generated at the movable contact 14 and heat generated at the coil 4, heat transmitted to the movable contact 14 via spring pieces 113 of a movable member 11 is transmitted from the movable contact 14 to the second fixed contact 15. The heat transmitted to the second fixed contact 15 is transmitted to the regulating member (contact plate) 12 and is then transmitted from the regulating member 12 to the lower flange 33 of the coil bobbin 3. Then, the heat transmitted to the lower flange 33 is transmitted to the terminal part 91 via the extended parts 97A, and the second projections 95 (see thermal path R2 in FIG. 6).

Here, in a state where the electromagnetic relay 100A is assembled, the terminal part 91 of the first terminal plate 9 (fixed terminal 1) protrudes out of a case C1. Therefore, when the electromagnetic relay 100A is used at low-temperature environment, the temperature of the one end (lower end) of the terminal part 91 decreases. However, when the heat from the movable contact 14 is transmitted to the terminal part 91 as in the case of the electromagnetic relay 100A of the first variation, the temperature of the terminal part 91 in the vicinity of a heat transmission structure 16 does not decrease much. Since the fixed contact 13 is disposed at a location closer to the heat transmission structure 16 than to the one end of the terminal part 91, the temperature of the fixed contact 13 attached to the other end of the terminal part 91 also does not decrease much. Therefore, it is possible to reduce a temperature difference between the temperature of the fixed contact 13 and the temperature of the vicinity of the fixed contact 13. Thus, according to the electromagnetic relay 100A of the first variation, moisture in air around the fixed contact 13 hardly forms condensation and freezes on the fixed contact 13, and it is therefore possible to reduce defects of electrical connection between the contacts due to freezing.

According to the electromagnetic relay 100A of the first variation, the extended part 97A is disposed at a location whose ambient temperature is higher than the ambient temperature at the location of the extended part 97 of the electromagnetic relay 100 according to the first embodiment, and therefore, it is possible to increase the temperature of the terminal part 91 as compared to the case of the electromagnetic relay 100. This further reduces defects of electrical connection between the contacts due to freezing as compared to the electromagnetic relay 100.

5.2. Other Variations

Other variations are listed below.

In the first embodiment or the first variation, the extended part 97 or 97A is provided on both sides of the fixed terminal 1 in the right and left direction. However, the extended part 97 or 97A may be provided on at least one side of the fixed terminal 1 in the right and left direction. In other words, the heat transmission structure 16 includes at least one extended part 97 or 97A.

In the first embodiment, the seal member 17 is provided between the upper surface of the extended part 97 and the lower surface of the lower flange 33 of the coil bobbin 3 which is a holding structure of the regulating member 12. However, the upper surface of the extended part 97 and the lower surface of the lower flange 33 may be in direct contact with each other. In other words, the tip end of the extended part 97 may be in contact with the holding structure (the coil bobbin 3) that holds the regulating member 12. This configuration provides the advantage that direct contact between the upper surface of the extended part 97 and the lower surface of the lower flange 33 improves the heat-transfer efficiency.

Moreover, in place of the seal member 17, a metallizing process may be performed on the lower surface of the lower flange 33 of the coil bobbin 3, and the upper surface of the extended part 97 and the lower surface of the lower flange 33 may be connected to each other by brazing.

In the first embodiment, a description is given of, for example, a case where the coil bobbin 3, which is part of the heat transmission structure 16, is the holding structure of the fixed terminal 1. However, a structure other than the coil bobbin 3 may serve as the holding structure of the fixed terminal 1.

In the first embodiment, a description is given of, for example, a case where the seal member 17 is an epoxy resin-based adhesive. However, the seal member 17 is not limited to the epoxy resin-based adhesive but may include a filler or may be conductive.

Second Embodiment

The present embodiment differs from the first embodiment (including the first variation) in that instead of the extended part 97 or 97A, an intermediate member 18 is disposed between a fixed terminal 1 and a regulating member 12. Note that components other than the intermediate member 18 are the same as those of the first embodiment, and therefore, the same components are denoted by the same reference signs as those in the first embodiment, and the description thereof is omitted.

(1) Configuration

An electromagnetic relay 100B according to the present embodiment includes a contact device A1 (see FIG. 1), an electromagnet device B1 (see FIG. 1), and a case C1 (see FIG. 1).

Figure 7:
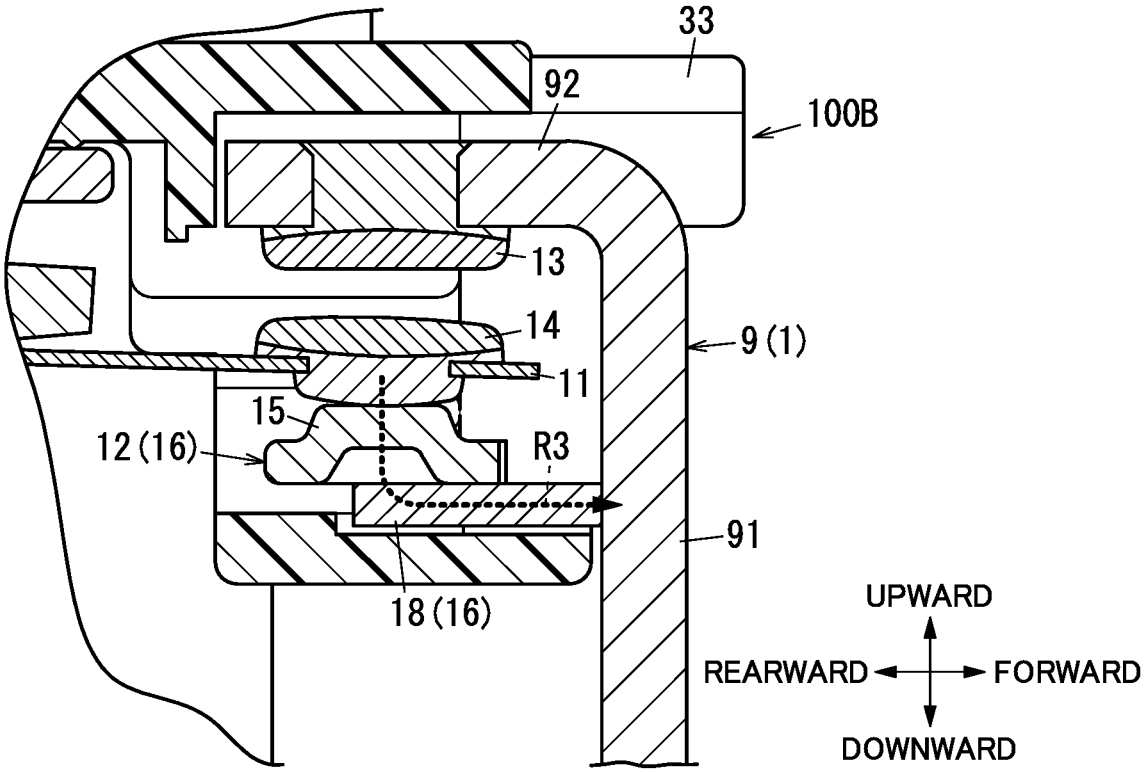
FIG. 7 is a sectional view illustrating a main part of an electromagnetic relay according to a second embodiment.

As illustrated in FIG. 7, the contact device A1 includes a first terminal plate 9 as a fixed terminal 1, a second terminal plate 10 (see FIG. 1), a movable member 11, a regulating member (contact plate) 12, and the intermediate member 18.

The intermediate member 18 is made of, for example, ceramics and has a rectangular shape when viewed in the upward and downward direction. Here, a coil bobbin 3 which is a holding structure that holds the fixed terminal 1 and the regulating member 12 is a molded product made of a synthetic resin as described above. That is, the intermediate member 18 has a higher thermal conductivity than the coil bobbin 3 and is electrically insulating. In other words, the intermediate member 18 has a higher thermal conductivity than a material whose component ratio is highest of materials included in a first holding structure that holds the fixed terminal 1 and a second holding structure that holds the regulating member 12, and the intermediate member 18 is electrically insulative.

The intermediate member 18 is in contact with the regulating member 12 and the fixed terminal 1 in an assembled state of the electromagnetic relay 100B. Specifically, an upper surface of the intermediate member 18 is bonded to a lower surface of the regulating member 12 via, for example, an adhesive. Moreover, the intermediate member 18 has an end which is located at its front surface side and which is bonded to a rear surface of a terminal part 91 of the first terminal plate 9 (the fixed terminal 1) via, for example, an adhesive. Unlike the electromagnetic relay 100 or 100A of the first embodiment (including the first variation), the coil bobbin 3, which is a holding structure that holds the fixed terminal 1 in the electromagnetic relay 100B of the present embodiment is not included in a heat transmission structure 16. In other words, the heat transmission structure 16 is a structure that differs from the holding structure (the coil bobbin 3) that holds the fixed terminal 1. In the present embodiment, the heat transmission structure 16 includes the regulating member (contact plate) 12 and the intermediate member 18.

(2) Operation

Next, operation of transmitting heat from a movable contact 14 to the fixed terminal 1 will be described with reference to FIG. 7. In FIG. 7, "R3" indicates a thermal path of heat transmitted from the movable contact 14 to a second fixed contact 15.

When the contact device A1 is in the ON state, the movable contact 14 is in contact with a fixed contact 13, and a current flows between the two contacts, and therefore, the temperature of the movable contact 14 is increasing. The temperature of a coil 4 is also increasing. When the contact device A1 transitions from the ON state to the OFF state, the movable contact 14 moves away from the fixed contact 13 and comes into contact with the second fixed contact 15. Of heat generated at the movable contact 14 and heat generated at the coil 4, heat transmitted to the movable contact 14 via spring pieces 113 of the movable member 11 is transmitted from the movable contact 14 to the second fixed contact 15. The heat transmitted to the second fixed contact 15 is transmitted to the regulating member (contact plate) 12 and is then transmitted from the regulating member 12 to the intermediate member 18. Then, the heat transmitted to the intermediate member 18 is transmitted to the terminal part 91 of the first terminal plate 9 (fixed terminal 1).

Here, in a state where the electromagnetic relay 100B is assembled, the terminal part 91 of the first terminal plate 9 (fixed terminal 1) protrudes out of a case C1. Therefore, when the electromagnetic relay 100B is used at low-temperature environment, the temperature of the one end (lower end) of the terminal part 91 decreases. However, when the heat from the movable contact 14 is transmitted to the terminal part 91 as in the case of the electromagnetic relay 100B of the present embodiment, the temperature of the terminal part 91 in the vicinity of the intermediate member 18 does not decrease much, and the temperature of the fixed contact 13 attached to the other end of the terminal part 91 also does not decrease much. Therefore, it is possible to reduce a temperature difference between the temperature of the fixed contact 13 and the temperature of the vicinity of the fixed contact 13. Thus, according to the electromagnetic relay 100B of the present embodiment, moisture in air around the fixed contact 13 hardly forms condensation and freezes on the fixed contact 13, and it is therefore possible to reduce defects of electrical connection between the contacts due to freezing.

(3) Variation

The second embodiment is only one of various embodiments of the present disclosure. Various modifications may be made to the second embodiment depending on design and the like as long as the object of the present disclosure is achieved. Variations of the second embodiment will be described below. Note that any of the variations to be described below may be combined as appropriate.

(3.1) First Variation

Figure 8:
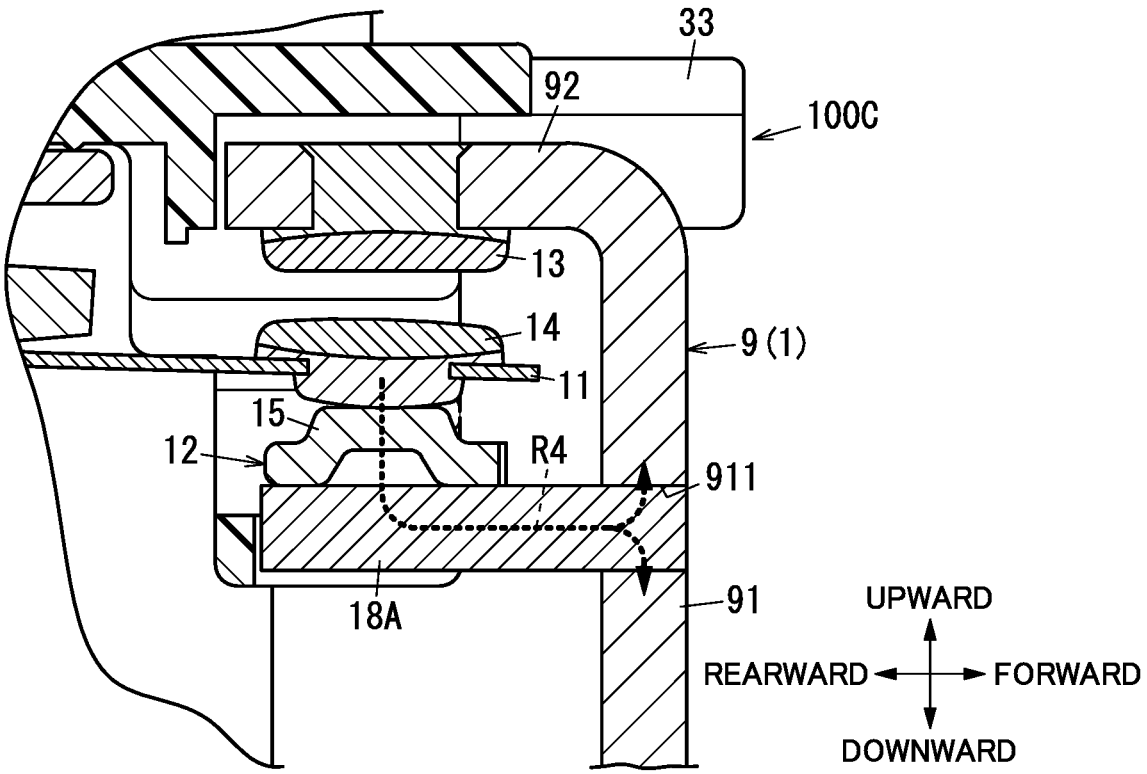
FIG. 8 is a sectional view illustrating a main part of an electromagnetic relay according to a first variation of the second embodiment.

In the second embodiment, the front surface of the intermediate member 18 is in contact with the rear surface of the terminal part 91 of the first terminal plate 9 (fixed terminal 1). However, as illustrated in FIG. 8, part of an intermediate member 18A may be inserted into a terminal part 91. An electromagnetic relay 100C according to a first variation of the second embodiment will be described below by referring to FIG. 8. Note that components other than the intermediate member 18A and a fixed terminal 1 (first terminal plate 9) are the same as those of the electromagnetic relay 100B of the second embodiment, and therefore, the same components are denoted by the same reference signs as those in the first embodiment, and the detailed description thereof is omitted.

(3.1.1) Configuration

As illustrated in FIG. 8, the first terminal plate 9 (the fixed terminal 1) according to the first variation includes the terminal part 91, a contact part 92, a pair of lugs 93 (see FIG. 1), a pair of first projections 94 (see FIG. 1), and a pair of second projections 95 (see FIG. 1). The terminal part 91 has an insertion section 911 penetrating the terminal part 91 in its thickness direction (the forward and rearward direction). The insertion section 911 has such a size that the intermediate member 18A is insertable in the insertion section 911. In other words, the fixed terminal 1 (first terminal plate 9) has the insertion section 911 in which the intermediate member 18A is insertable.

In a state where the electromagnetic relay 100C is assembled, a front end of the intermediate member 18A is inserted into the insertion section 911 of the terminal part 91. Note that the intermediate member 18A is preferably bonded to an inner surface of the insertion section 911 via, for example, an adhesive.

(3.1.2) Operation

Next, operation of transmitting heat from a movable contact 14 to the fixed terminal 1 will be described with reference to FIG. 8. In FIG. 8, "R4" indicates a thermal path of heat transmitted from the movable contact 14 to a second fixed contact 15.

When a contact device A1 is in the ON state, the movable contact 14 is in contact with a fixed contact 13, and a current flows between the two contacts, and therefore, the temperature of the movable contact 14 is increasing. The temperature of a coil 4 is also increasing. When the contact device A1 transitions from the ON state to the OFF state, the movable contact 14 moves away from the fixed contact 13 and comes into contact with the second fixed contact 15. Of heat generated at the movable contact 14 and heat generated at the coil 4, heat transmitted to the movable contact 14 via spring pieces 113 of a movable member 11 is transmitted from the movable contact 14 to the second fixed contact 15. The heat transmitted to the second fixed contact 15 is transmitted to a regulating member (contact plate) 12 and is then transmitted from the regulating member 12 to the intermediate member 18A. Then, the heat transmitted to the intermediate member 18A is transmitted to the terminal part 91.

Here, in a state where the electromagnetic relay 100C is assembled, the terminal part 91 of the first terminal plate 9 (fixed terminal 1) protrudes out of a case C1. Therefore, when the electromagnetic relay 100C is used at low-temperature environment, the temperature of one end (lower end) of the terminal part 91 decreases. However, when the heat from the movable contact 14 is transmitted to the terminal part 91 as in the case of the electromagnetic relay 100C of the first variation, the temperature of the terminal part 91 in the vicinity of the intermediate member 18A does not decrease much, and the temperature of the fixed contact 13 attached to the other end of the terminal part 91 also does not decrease much. Therefore, it is possible to reduce a temperature difference between the temperature of the fixed contact 13 and the temperature of the vicinity of the fixed contact 13. Thus, according to the electromagnetic relay 100C of the first variation, moisture in air around the fixed contact 13 hardly forms condensation and freezes on the fixed contact 13, and it is therefore possible to reduce defects of electrical connection between the contacts due to freezing.

(3.2) Second Variation

Figure 9:
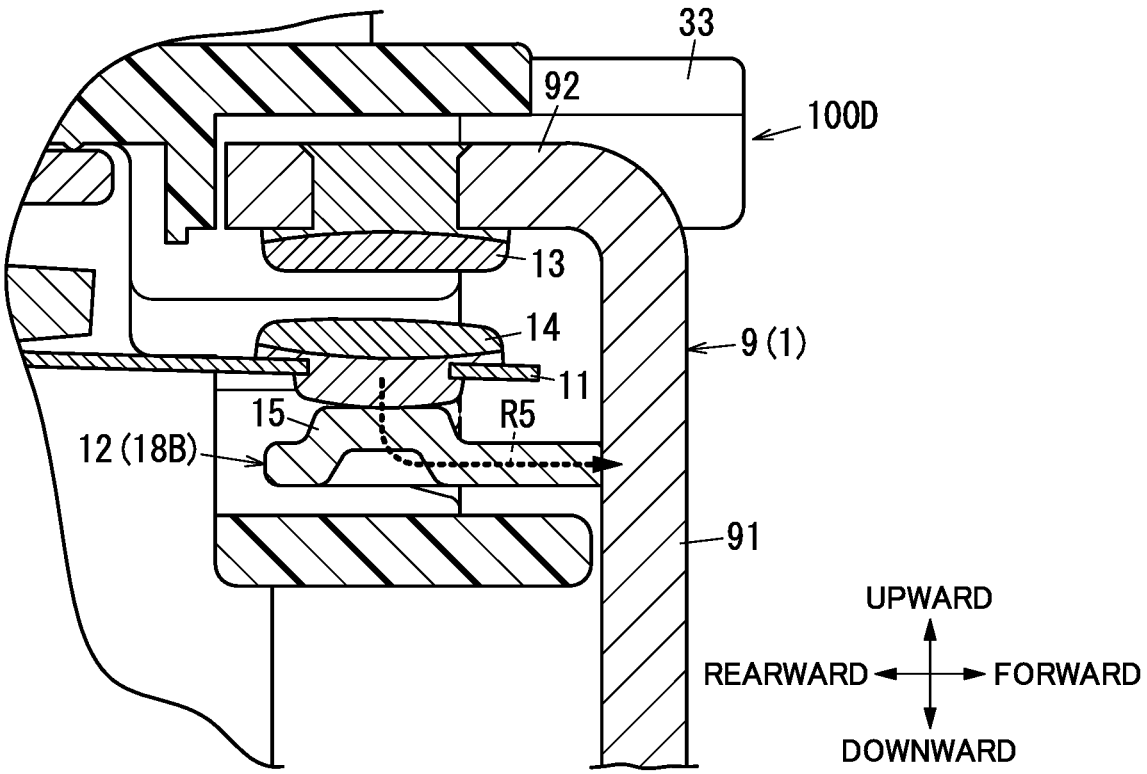
FIG. 9 is a sectional view illustrating a main part of an electromagnetic relay according to a second variation of the second embodiment.

In the second embodiment, the regulating member 12 and the intermediate member 18 are separate from each other. However, as illustrated in FIG. 9, a regulating member 12 and an intermediate member 18B may be integrated with each other. In other words, the regulating member 12 and an intermediate member 18B may be an identical member. An electromagnetic relay 100D according to a second variation of the second embodiment will be described below by referring to FIG. 9. Note that components other than the regulating member 12 (the intermediate member 18B) are the same as those of the electromagnetic relay 100B of the second embodiment, and therefore, the same components are denoted by the same reference signs as those in the first embodiment, and the detailed description thereof is omitted.

(3.2.1) Configuration

As illustrated in FIG. 9, the intermediate member 18B according to the second variation is an identical member to the terminal plate (regulating member) 12 including a second fixed contact 15. The intermediate member 18B is made of, for example, ceramics. In a state where the electromagnetic relay 100D is assembled, the intermediate member 18B has an end which is located at its front surface side and which is in contact with a rear surface of a terminal part 91 of a first terminal plate 9 (fixed terminal 1). Note that the intermediate member 18B is preferably bonded to the terminal part 91 via, for example, an adhesive. Alternatively, a front end of the intermediate member 18B may be configured to be inserted in an insertion section formed in the terminal part 91.

(3.2.2) Operation

Next, operation of transmitting heat from a movable contact 14 to the fixed terminal 1 will be described with reference to FIG. 9. In FIG. 9, "R5" indicates a thermal path of heat transmitted from the movable contact 14 to the second fixed contact 15.

When a contact device A1 is in the ON state, the movable contact 14 is in contact with a fixed contact 13, and a current flows between the two contacts, and therefore, the temperature of the movable contact 14 is increasing. The temperature of a coil 4 is also increasing. When the contact device A1 transitions from the ON state to the OFF state, the movable contact 14 moves away from the fixed contact 13 and comes into contact with the second fixed contact 15. Of heat generated at the movable contact 14 and heat generated at the coil 4, heat transmitted to the movable contact 14 via spring pieces 113 of a movable member 11 is transmitted from the movable contact 14 to the second fixed contact 15. The heat transmitted to the second fixed contact 15 is transmitted to the intermediate member 18B (regulating member 12) and is then transmitted from the intermediate member 18B to the terminal part 91.

Here, in a state where the electromagnetic relay 100D is assembled, the terminal part 91 of the first terminal plate 9 (fixed terminal 1) protrudes out of a case C1. Therefore, when the electromagnetic relay 100D is used at low-temperature environment, the temperature of the one end (lower end) of the terminal part 91 decreases. However, when the heat from the movable contact 14 is transmitted to the terminal part 91 as in the case of the electromagnetic relay 100D of the second variation, the temperature of the terminal part 91 in the vicinity of the intermediate member 18B does not decrease much, and the temperature of the fixed contact 13 attached to the other end of the terminal part 91 also does not decrease much. Therefore, it is possible to reduce a temperature difference between the temperature of the fixed contact 13 and the temperature of the vicinity of the fixed contact 13. Thus, according to the electromagnetic relay 100D of the second variation, moisture in air around the fixed contact 13 hardly forms condensation and freezes on the fixed contact 13, and it is therefore possible to reduce defects of electrical connection between the contacts due to freezing.

(3.3) Others Variation

Other variations are listed below.

In the second embodiment, the coil bobbin 3 consists of a synthetic resin. However, the coil bobbin 3 may be made of a plurality of materials containing the synthetic resin. Here, when of the plurality of materials, the synthetic resin having a lower thermal conductivity than the intermediate member 18 has the highest component ratio, using the intermediate member 18 increases the effectiveness of reducing defects of electrical connection between contacts due to freezing.

In the second embodiment, the description is given of the case where the intermediate member 18 is made of ceramics. However, materials for the intermediate member 18 are not limited to ceramics. The intermediate member 18 may be made of any other material as long as it has higher thermal conductivity than each of the first holding structure that holds the fixed terminal 1 and the second holding structure that holds the regulating member 12, and it is electrically insulating.

The configuration described in the second embodiment (including the variations) is accordingly applicable in combination with the configuration (including variations) described in the first embodiment.

Summary

As described above, a contact device (A1) of a first aspect includes: a fixed terminal (1), a movable member (11), a regulating member (12), and a heat transmission structure (16). The fixed terminal (1) includes a fixed contact (13). The movable member (11) includes a movable contact (14) and is configured to move between a closed position where the movable contact (14) is in contact with the fixed contact (13) and an open position where the movable contact (14) is apart from the fixed contact (13). The regulating member (12) is configured to be in contact with the movable contact (14) when the movable member (11) is in the open position. The heat transmission structure (16) is configured to transmit, to the fixed terminal (1), heat from the movable contact (14) when the movable member (11) is in the open position, through a thermal path (R1 to R5) including at least the regulating member (12).

This aspect enables heat from the movable contact (14) to be transmitted to the fixed terminal (1) via the heat transmission structure (16), and therefore, the temperature of the fixed terminal (1) is less likely to decrease even when the contact device is used in a low-temperature environment. Therefore, the temperature of the fixed contact (13) does not decrease much, moisture in air around the fixed contact (13) hardly forms condensation and freezes on the fixed contact (13), and it is therefore possible to reduce defects of electrical connection between the contacts due to freezing.

In a contact device (A1) of a second aspect referring to the first aspect, the heat transmission structure (16) is a structure that differs from a holding structure (a coil bobbin (3)) that holds the fixed terminal (1).

This aspect enables the degree of freedom of design of the holding structure to be increased as compared to a case where the heat transmission structure (16) and the holding structure are integrated with each other.

In a contact device (A1) of a third aspect referring to the first or second aspect, the heat transmission structure (16) includes at least one extended part (97, 97A) extending from the fixed terminal (1) toward the regulating member (12).

This aspect enables the heat from the movable contact (14) to be transmitted to the fixed terminal (1) via the regulating member (12) and the at least one extended part (97, 97A).

In a contact device (A1) of a fourth aspect referring to the third aspect, the at least one extended part (97, 97A) is integrated with the fixed terminal (1).

This aspect provides the advantage that the thermal conductivity between the at least one extended part (97, 97A) and the fixed terminal (1) is improved as compared to a case where the at least one extended part (97, 97A) is separate from the fixed terminal (1).

In a contact device (A1) of a fifth aspect referring to the third or fourth aspect, the at least one extended part (97, 97A) includes a plurality of extended parts (97, 97A). At least one of the plurality of extended parts (97, 97A) is provided on a one of both sides of the fixed terminal (1) and a rest of the plurality of extended parts (97, 97A) is provided on the other of the both sides of the fixed terminal (1) in a direction (right and left direction) transverse to a direction (upward and downward direction) in which the fixed contact (13) and the movable contact (14) are aligned with each other.

This aspect provides the advantage that the heat transfer property is improved as compared to a case where one extended part (97, 97A) is provided.

In a contact device (A1) of a sixth aspect referring to any one of the third to fifth aspects, the at least one extended part (97, 97A) has a tip end in contact with a holding structure (a coil bobbin 3) that holds the regulating member 12.

This aspect provides the advantage that the degree of close contact between the holding structure and the at least one extended part (97, 97A) is increased and the thermal conductivity is improved.

In a contact device (A1) of a seventh aspect referring to any one of the third to fifth aspects, the at least one extended part (97, 97A) has a tip end facing a holding structure (a coil bobbin (3)) that holds the regulating member (12). In the contact device (A1), a seal member (17) is provided in a gap between the tip end of the at least one extended part (97, 97A) and a counter portion of the holding structure, the counter portion facing the tip end of the at least one extended part (97, 97A).

With this aspect, the seal member (17) increases the degree of close contact between the holding structure and the at least one extended part (97, 97A) and improves the thermal conductivity.

In a contact device (A1) of an eighth aspect referring to the first or second aspect, the heat transmission structure (16) includes an intermediate member (18, 18A, 18B) located between the fixed terminal (1) and the regulating member (12). The intermediate member (18, 18A, 18B) has a higher thermal conductivity than a material whose component ratio is highest of materials included in a first holding structure that holds the fixed terminal (1) and a second holding structure that holds the regulating member (12), and the intermediate member (18, 18A, 18B) is electrically insulating.

This aspect enables the heat from movable contact (14) to be transmitted to the fixed terminal (1) via the regulating member (12) in contact with the movable contact (14) and the intermediate member (18, 18A, 18B).

In a contact device (A1) of a ninth aspect referring to the eighth aspect, the intermediate member (18, 18A, 18B) is made of ceramics.

This aspect enables electrical insulation between the movable contact (14) and the fixed terminal (1) to be secured while heat is transmitted from the movable contact (14) to the fixed terminal (1).

In a contact device (A1) of a tenth aspect referring to the eighth or ninth aspect, the regulating member (12) and the intermediate member (18B) are formed as an identical member.

This aspect provides the advantage that the degree of close contact is increased and thermal conductivity is improved as compared to a case where the regulating member (12) and the intermediate member (18B) are formed as separate members.

In a contact device (A1) of an eleventh aspect referring to any one of the eighth to tenth aspects, the fixed terminal (1) has an insertion section (911) in which the intermediate member (18A) is insertable.

This aspect provides the advantage that an area where the fixed terminal (1) and the intermediate member (18A) are in contact with each other is increased, and therefore, the thermal conductivity is improved.

In a contact device (A1) of a twelfth aspect referring to any one of the first to eleventh aspects, the fixed terminal (1) has a terminal part (91) protruding out of a case (C1) accommodating at least part of the fixed terminal (1). The thermal path (R1 to R5) is connected between the fixed contact (13) and one end of the terminal part (91) of the fixed terminal (1).

This aspect can make the fixed contact (13) less susceptible to the influence of a temperature drop at the one end of the terminal part (91).

An electromagnetic relay (100, 100A, 100B, 100C, 100D) of a thirteenth aspect includes: the contact device (A1) of any one of the first to twelfth aspects; and an electromagnet (2) having a coil (4).

According to this aspect, use of the contact device (A1) of any one of the first to twelfth aspects enables defects of electrical connection between the contacts due to freezing to be reduced.

In an electromagnetic relay (100, 100A, 100B, 100C, 100D) according to a fourteenth aspect referring to the thirteenth aspect, the electromagnet (2) further includes a coil bobbin (3) around which the coil (4) is wound. The fixed terminal (1) and the regulating member (12) are held by the coil bobbin (3).

This aspect provides the advantage that positional accuracy between the fixed terminal (1) and the regulating member (12) is improved and thermal conductivity is improved as compared to a case where one of the fixed terminal (1) and the regulating member (12) is held by a member other than the coil bobbin (3).

The configurations of the second to twelfth aspects are not essential to the contact device (A1) and may accordingly be omitted.

The configuration of the fourteenth aspect is not essential to the electromagnetic relay (100, 100A, 100B, 100C, 100D) and may accordingly be omitted.

REFERENCE SIGNS LIST

1 FIXED TERMINAL
13 FIXED CONTACT
91 TERMINAL PART
911 INSERTION SECTION
97, 97A EXTENDED PART
2 ELECTROMAGNET
3 COIL BOBBIN
4 COIL
11 MOVABLE MEMBER
14 MOVABLE CONTACT
12 CONTACT PLATE (REGULATING MEMBER)
16 HEAT TRANSMISSION STRUCTURE
17 SEAL MEMBER
18, 18A, 18B INTERMEDIATE MEMBER
100, 100A, 100B, 100C, 100D ELECTROMAGNETIC RELAY
A1 CONTACT DEVICE
C1 CASE

The invention claimed is:

1. A contact device, comprising:

a fixed terminal including a fixed contact;

a movable member including a movable contact and being configured to move between a closed position where the movable contact is in contact with the fixed contact and an open position where the movable contact is apart from the fixed contact;

a regulating member configured to be in contact with the movable contact when the movable member is in the open position; and a heat transmission structure configured to transmit, to the fixed terminal, heat from the movable contact when the movable member is in the open position, through a thermal path including at least the regulating member, wherein the heat transmission structure includes at least one extended part extending from the fixed terminal toward the regulating member, the at least one extended part includes a plurality of extended parts, and at least one of the plurality of extended parts is provided on one of both sides of the fixed terminal and a rest of the plurality of extended parts is provided on the other of the both sides of the fixed terminal in a direction transverse to a direction in which the fixed contact and the movable contact are aligned with each other.

2. The contact device of claim 1, wherein the heat transmission structure is a structure that differs from a holding structure that holds the fixed terminal.

3. The contact device of claim 1, wherein the at least one extended part is integrated with the fixed terminal.

4. The contact device of claim 1, wherein the at least one extended part has a tip end in contact with a holding structure that holds the regulating member.

5. The contact device of claim 1, wherein the fixed terminal has a terminal part protruding out of a case accommodating at least part of the fixed terminal, and the thermal path is connected between the fixed contact and one end of the terminal part of the fixed terminal.

6. An electromagnetic relay, comprising:

the contact device of claim 1; and an electromagnet having a coil.

7. The electromagnetic relay of claim 6, wherein the electromagnet further includes a coil bobbin around which the coil is wound, and the fixed terminal and the regulating member are held by the coil bobbin.

8. A contact device, comprising:

a fixed terminal including a fixed contact;

a movable member including a movable contact and being configured to move between a closed position where the movable contact is in contact with the fixed contact and an open position where the movable contact is apart from the fixed contact;

a regulating member configured to be in contact with the movable contact when the movable member is in the open position; and a heat transmission structure configured to transmit, to the fixed terminal, heat from the movable contact when the movable member is in the open position, through a thermal path including at least the regulating member, wherein the heat transmission structure includes at least one extended part extending from the fixed terminal toward the regulating member, the at least one extended part has a tip end facing a holding structure that holds the regulating member, and a seal member is provided in a gap between the tip end of the at least one extended part and a counter portion of the holding structure, the counter portion facing the tip end of the at least one extended part.

9. A contact device, comprising:

a fixed terminal including a fixed contact;

a movable member including a movable contact and being configured to move between a closed position where the movable contact is in contact with the fixed contact and an open position where the movable contact is apart from the fixed contact;

a regulating member configured to be in contact with the movable contact when the movable member is in the open position; and a heat transmission structure configured to transmit, to the fixed terminal, heat from the movable contact when the movable member is in the open position, through a thermal path including at least the regulating member, wherein the heat transmission structure includes an intermediate member located between the fixed terminal and the regulating member, and the intermediate member has a higher thermal conductivity than a material whose component ratio is highest of materials included in a first holding structure that holds the fixed terminal and a second holding structure that holds the regulating member, and the intermediate member is electrically insulating.

10. The contact device of claim 9, wherein the intermediate member is made of ceramics.

11. The contact device of claim 9, wherein the regulating member and the intermediate member are formed as an identical member.

12. The contact device of claim 9, wherein the fixed terminal has an insertion section in which the intermediate member is insertable.

* * * * *